US007159710B2

(12) United States Patent
O'Brien et al.

(10) Patent No.: US 7,159,710 B2
(45) Date of Patent: Jan. 9, 2007

(54) LOCKING GIFT BOX

(75) Inventors: Patrick O'Brien, York, ME (US); Gary Drach, Wayne, NJ (US)

(73) Assignee: Hub Folding Box Company, Inc., Mansfield, MA (US)

( * ) Notice: Subject to any disclaimer, the term of this patent is extended or adjusted under 35 U.S.C. 154(b) by 71 days.

(21) Appl. No.: 10/293,519

(22) Filed: Nov. 13, 2002

(65) Prior Publication Data

US 2004/0010954 A1 Jan. 22, 2004

Related U.S. Application Data

(63) Continuation-in-part of application No. 10/198,901, filed on Jul. 19, 2002, now abandoned.

(51) Int. Cl.
*A45C 13/00* (2006.01)

(52) U.S. Cl. ..... 206/1.5; 206/776

(58) Field of Classification Search ..... 206/1.5, 206/308.2, 387.11, 775, 776, 499; 220/324, 220/326, 315, 377, 786; 229/164
See application file for complete search history.

(56) References Cited

U.S. PATENT DOCUMENTS

| | | | | | |
|---|---|---|---|---|---|
| 2,223,770 | A | | 12/1940 | Nagle | |
| 3,176,900 | A | | 4/1965 | Ciganenko | |
| 3,392,902 | A | | 7/1968 | Donovan | |
| 4,381,836 | A | * | 5/1983 | Rivkin et al. | 206/387.11 |
| 4,718,547 | A | * | 1/1988 | MacTavish | 206/308.2 |
| 4,805,769 | A | * | 2/1989 | Soltis et al. | 206/308.2 |
| 5,297,672 | A | * | 3/1994 | MacTavish | 206/308.2 |
| 5,417,319 | A | * | 5/1995 | Chalberg et al. | 206/1.5 |
| 6,135,280 | A | * | 10/2000 | Burdett et al. | 206/387.11 |

* cited by examiner

*Primary Examiner*—Jila M. Mohandesi
(74) *Attorney, Agent, or Firm*—Fish & Richardson P.C.

(57) ABSTRACT

A display box that includes: a) a base having a bottom and at least one wall that terminates in an upper perimeter, b) a product display holder positioned in the base, and c) a cover for the base. The cover comprises a clear window and a frame that contains the window. The frame irreversibly engages the upper perimeter of the base wall.

7 Claims, 6 Drawing Sheets

LOCKING GIFT BOX

RELATED APPLICATION

This is a continuation-in-part of U.S. Ser. No. 10/198,901, filed Jul. 19, 2002, now abandoned which is hereby incorporated by reference.

TECHNICAL FIELD

This invention relates to the general field of gift packaging, particularly boxes with clear tops to display higher-end products.

BACKGROUND

Certain higher-end products—such as cosmetics, perfumes, colognes, toiletries, jewelry, novelties, and pen/pencil sets—are packaged in attractive display boxes for point-of-sale display or merchandising. Often boxes for these products have a large, clear plastic window on the cover or front and appealing graphics on the sides and back. A typical package for these types of products may include either a set-up box base or paperboard tray base with a thermoformed plastic tray inside to hold the product. A clear plastic die-cut window (usually made of PVC or PET) is affixed to the package. The window panel usually covers the whole front face or cover of the box for maximum visual effect.

The window may include flaps extending off all four sides (connected to the main panel by living hinges). In one assembly technique, the window flaps are folded 90 degrees. Hot melt glue is then applied to the outside of flaps by hand. The window is then inserted into the tray, sealing the flaps to the inside walls of the tray. This design inhibits pilferage since the package is sealed on all four sides. While this design addresses certain merchandising needs, it is slow to assemble and a certain number of boxes will be rejected as aesthetically unacceptable due to misplacement or angel-hairing of the hot melt.

SUMMARY

Generally stated, the invention features a display box that includes: a) a base having a bottom and at least one wall that terminates in an upper perimeter, b) a product display holder positioned in the base, and c) a cover for the base. The cover comprises a clear window and a frame that contains the window. The frame irreversibly engages the upper perimeter of the base wall. We use the terms "bottom", "sides" and "cover" to include not only a rectangular box with a top (cover), but also to boxes of less common shapes (even cylindrical, which will have a single curved wall). We also do not imply any specific orientation of the display box. While the "cover" will be the face opposite the "bottom", the box may be displayed so that it can be viewed from the front. In that case the front would be the "cover" and the top of the box would be a side or wall of the base; the "bottom" would then be the "back" of the box.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
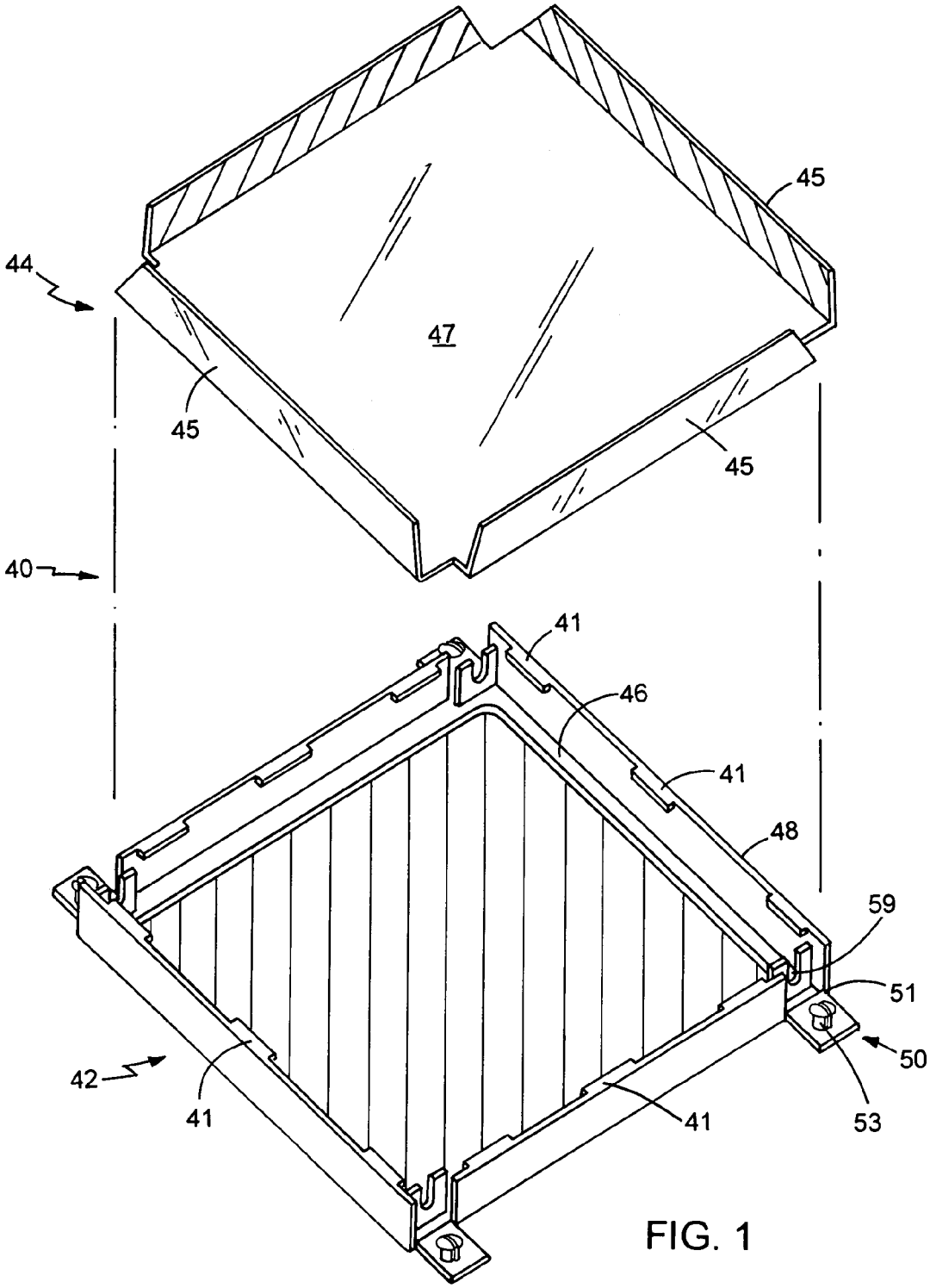
FIG. 1 is an exploded view of an inverted gift box cover.

Gift box 10 of FIG. 1 includes a rectangular base 12 that includes a bottom 14 and side walls 16, 18, 20 and 22 extending upwardly from the base. Base 12 can be any suitable container such as a standard set up box base or paperboard tray base or other container well known to those in the field. Typically base 12 is a printed paperboard base tray.

A thermoformed plastic tray 30 (FIG. 6) fits within base 12 to contain and display a product. Tray 30 is an optional ornamental aspect of the box.

Figure 2:
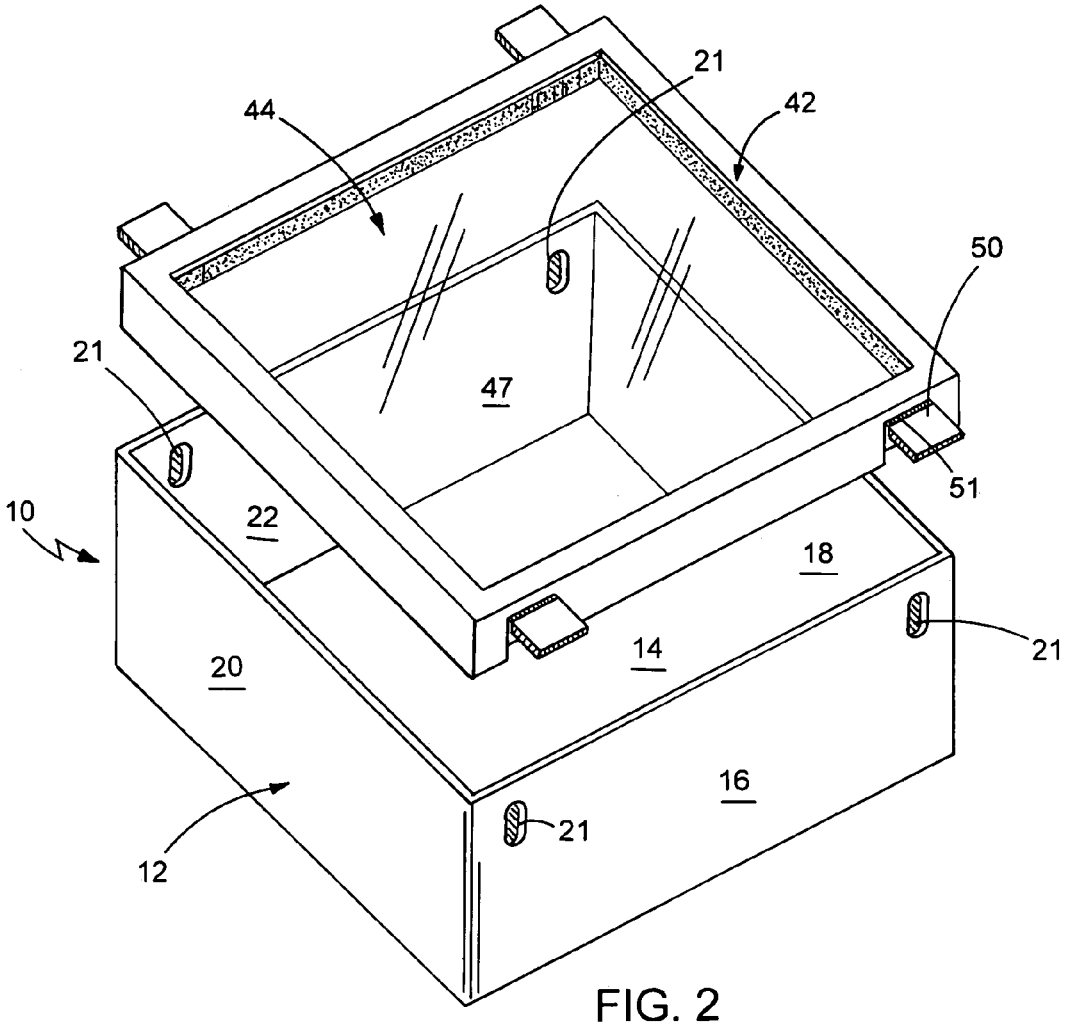
FIG. 2 is an exploded view of a gift box cover together with a base. The plastic tray of the box has been omitted for clarity.

Cover 40 includes an injection-molded peripheral frame 42 surrounding a clear, semi-rigid plastic window 44. In FIG. 2, frame 42 of cover 40 is inverted showing its underside. Frame 42 includes parallel rails 46 and 48 spaced to accommodate the upper perimeter of base side walls 16–22. Frame 42 is sized so that window 44 can be snapped into frame 42.

Window 44 has flaps 45 extending off four sides, connected to the main panel 47 via living hinges 49. The flaps 45 are bent 90 degrees and the window is inserted inside the frame. The flaps have some "fight-back" to them (i.e., the hinges 49 are somewhat resilient) so they press out against the inner walls of outer frame rails 48. Tabs 41 (FIG. 1) along the inside walls of the rails 48 engage the edges of the flaps 45 to keep the window in place. Since the main window panel 47 and window flaps 45 are flush against the inner walls of outer rail 48, both components overlap the base tray walls upon attachment. Having the window flaps wrap over the base walls prevents someone from pressing into the box via the window to access the product.

Figure 3:
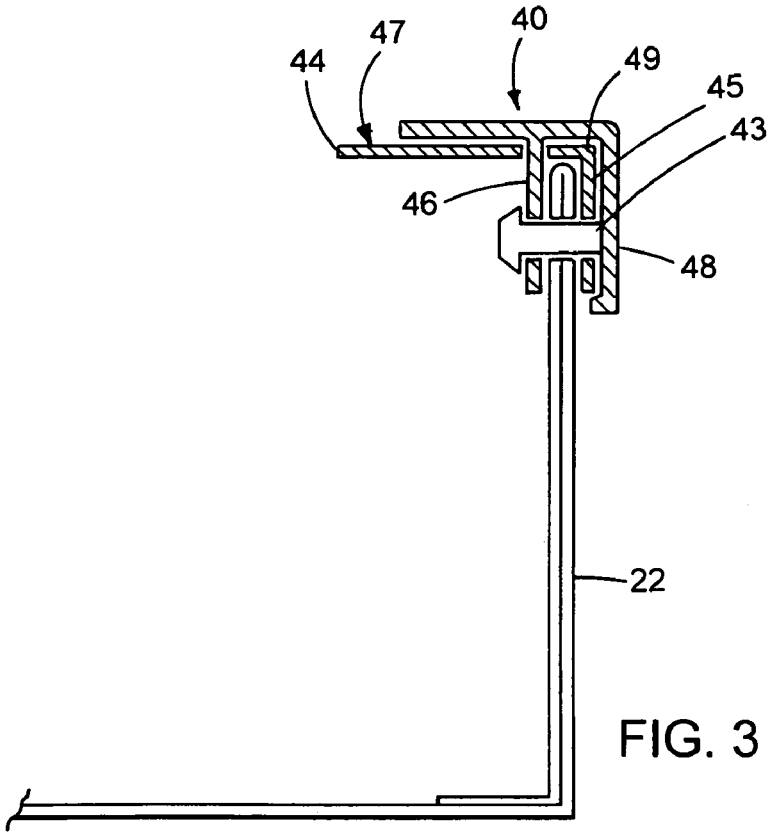
FIG. 3 is a enlarged section of an assembled gift box, with the plastic tray omitted for clarity.

Once cover 40 (i.e., the combined components frame 42 and window 44) is assembled, the assembly is placed onto the base tray and locked in position by way of four locking tabs, each numbered 50. When tabs 50 are in the locked position they cannot be re-opened; the package must be destroyed to access the product. Specifically, one of the tabs 50 is located in each corner on opposing sidewalls. Each tab 50 is connected to the frame via a living hinge 51. Each tab 50 includes a pin 53 extending from the inner wall of tab 50. As best shown in FIG. 3, when the frame is placed onto the base tray and each tab 50 is pressed inward, pin 53 passes through a hole 43 in window flap 45, a hole 21 in side wall 20, and U-shaped slot 59 on inner rail 46. Alternatively, the window shown in FIG. 1 has corners cut away so that pin 53 does not engage window 44.

Pin 53 is a locking pin so that it cannot be removed after insertion. In one embodiment shown in FIGS. 1 and 3, pin 53 has flared ends with a split configuration to allow the pin to flex past the U-shaped slot 59. The pin 53 then expands back to its original width, creating a permanent lock. Since the pin travels through the base sidewall 20 via a hole 21, the cover 40 becomes inter-locked with the frame 42. The package must be destroyed to access the product. This design offers fast assembly of the cover to the base without the problems associated with adhesives.

Figure 5:
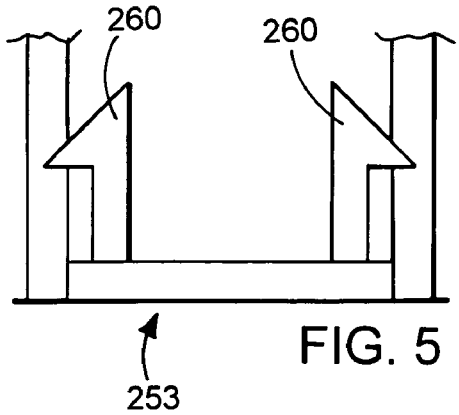
FIG. 5 is an enlargement of another alternative locking pin.
Figure 4:
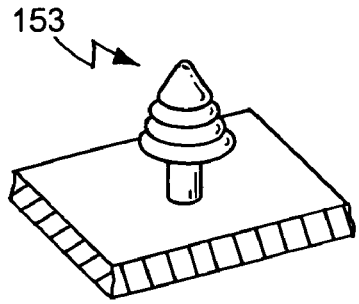
FIG. 4 is an enlargement of an alternative locking pin.

A number of embodiments of the invention have been described. Nevertheless, it will be understood that various modifications may be made without departing from the spirit and scope of the invention. For example, various types of locking pins can be used as illustrated in FIG. 3 and FIG. 5. In FIG. 4, pin 153 has a "Christmas tree" shape that inhibits or prevents removal. In FIG. 5, pin 253 has a barbed hooks 260 on each end of the split.

Figure 6:
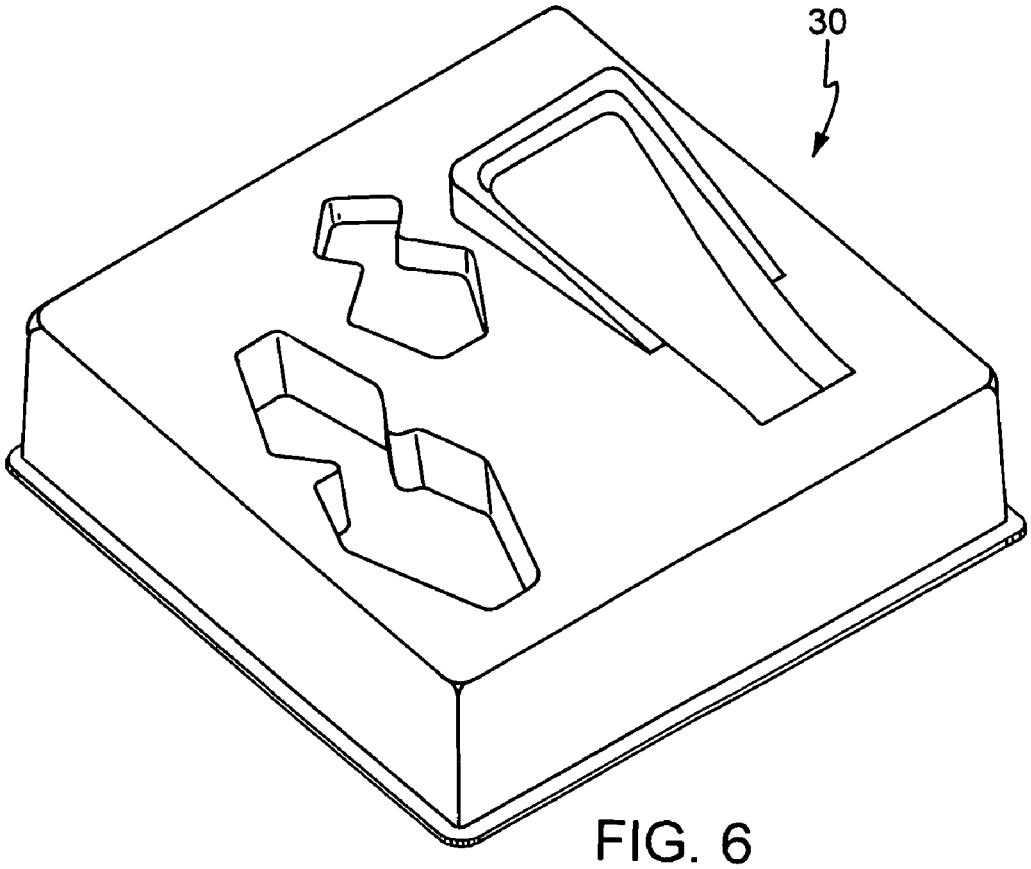
FIG. 6 is a view of a thermoform tray.
Figure 7:
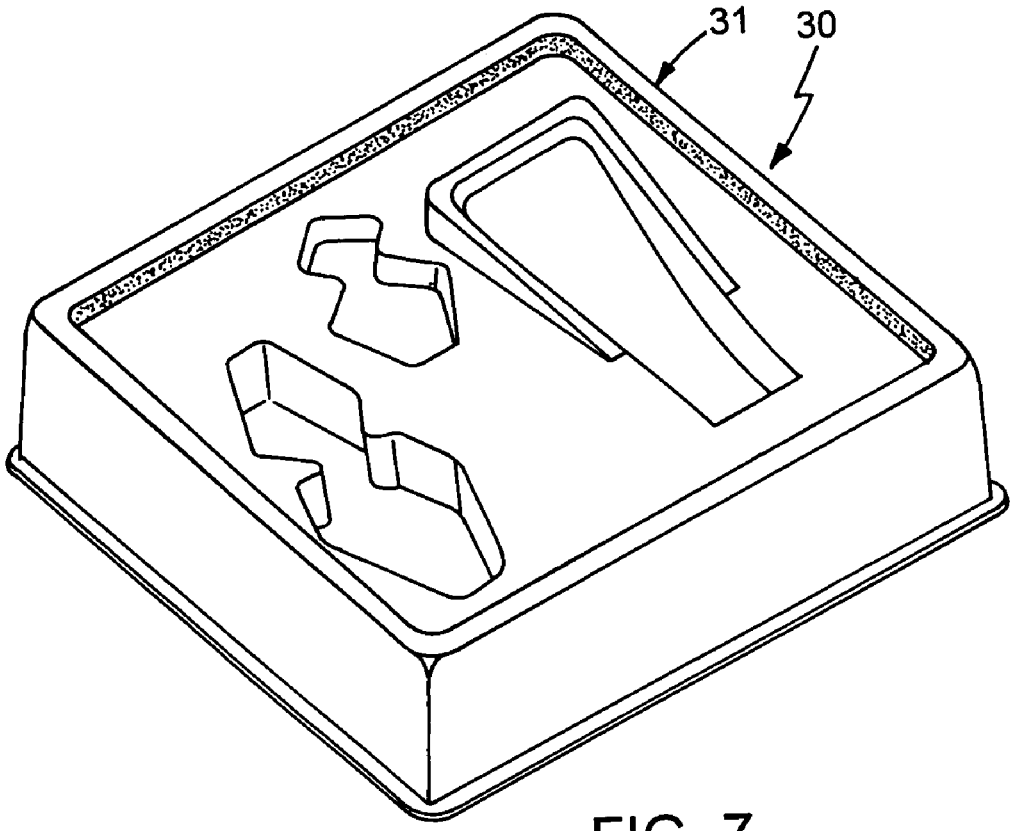
FIG. 7 is a view of an alternative thermoform tray with a raised wall.

FIG. 7 shows an alternative thermoform tray 30 that is generally like the tray shown in FIG. 6, but that includes a raised wall 31 extending around the perimeter. The raised wall tends to keep the window panel film 47 of window 44 from being pushed down toward the merchandise in tray 30, thus providing added protection for the merchandise. The raised wall should be designed keeping in mind the extent to which product in the tray will extend above the surface of the tray. Typically the raised wall will be relatively narrow (e.g., about 0.187" wide).

Figure 8:
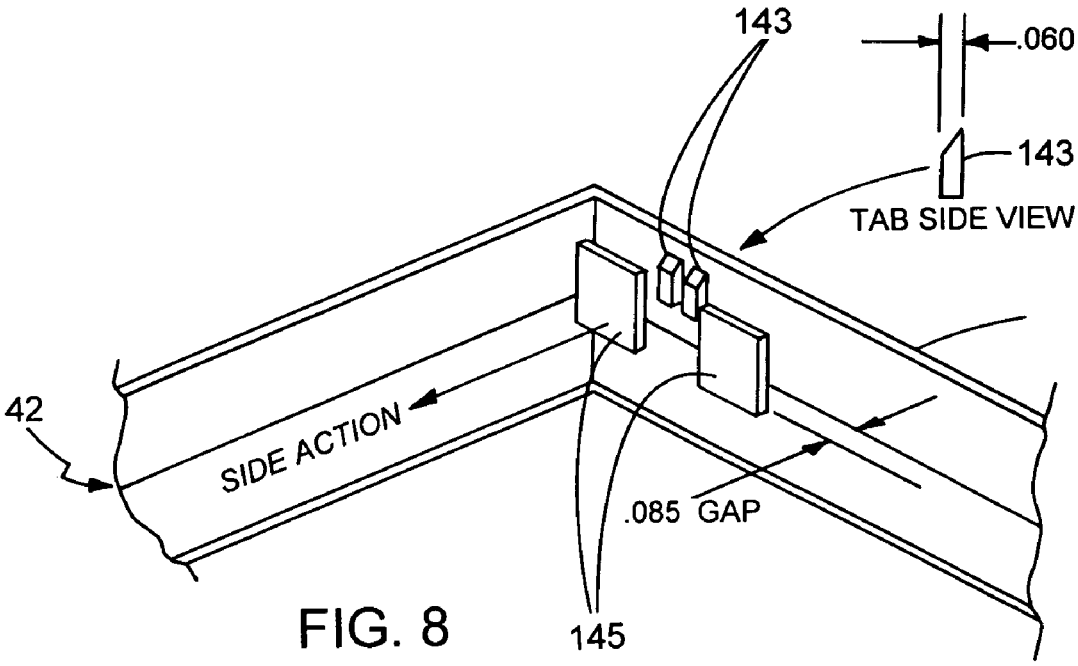
FIG. 8 is a partial view of an alternative gift box cover.
Figure 9:
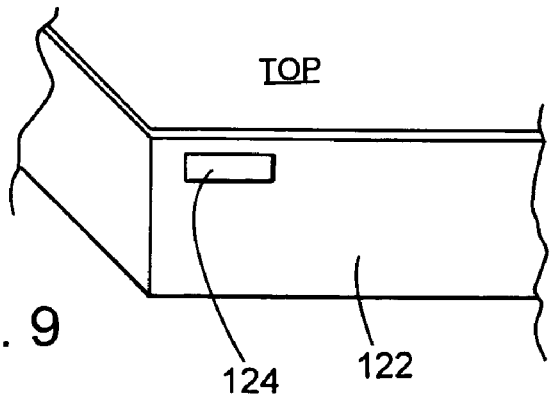
FIG. 9 is a partial view of the wall of a gift box designed for use with the cover of FIG. 8.

FIG. 8 shows a portion of an alternative frame 42 for cover 40. In place of the lock mechanism shown in FIG. 3, the alternative frame includes two ribs 143 attached to the inside of outer rail 148. Two containment members 145 are spaced from outer rail 148 a distance selected to form a friction fit with board wall 122. For example, the ribs extend about 0.060" from the inner wall of rail 148. The gap between the inner wall of rail 148 and the outer wall of containment members 145 is about 0.085", which will accommodate the side wall 22 in a snug fit. Board wall 122 (FIG. 9) has a slot 124 positioned and sized to receive ribs 143. Ribs 143 have are beveled at the ends. As the cover is forced over the box during assembly, ribs 143 force frame wall 42 outwardly until the ribs encounter slot 124. Containment members 145 prevent a shoplifter from pushing board wall 122 inwardly to slide ribs 143 out of slots 124, a process that is necessary to remove cover 40 from the base 12. The locking mechanism is strategically placed near the corners of th frame where the framesidewalls are less flexible, thus preventing a shoplifter from pulling the wall outward todisengage the ribs. For example, the slot is close enough to a corner of the base wall that the corner provides the region with strength resisting lateral wall movement that would disengage the slot and the elongated member. For example the slot can be positioned from 0.01" To 3.0" from the corner.

Accordingly, other embodiments are within the scope of the following claims.

What is claimed is:

1. A display box comprising, a) a base having a bottom and at least one base wall that terminates in an upper perimeter, the base wall further comprising a slot, b) a product display holder positioned in the base, and c) a cover for the base, the cover comprising, i) a clear window, and ii) a frame that contains the window, the frame irreversibly engaging the upper perimeter of the base wall, said frame comprising a perimeter wall and at least two containment walls, said containment walls being spaced from said perimeter wall to allow the thickness of the base wall to be accomodated snugly between the containment walls and the frame perimeter wall, the frame further comprising at least one elongated rib offset from, and positioned between, the containment walls and in a location that mates with the slot in the base wall when the cover is properly attached to the base.

2. The box of claim 1 in which the product display holder includes a raised portion sized and position to separate the clear window from the display holder.

3. The box of claim 1 in which the slot is located in a region of the base wall close enough to a corner of the base wall that the corner provides the region with strength resisting lateral wall movement that would disengage the slot and the elongated rib.

4. The box of claim 1 in which the slot and the elongated rib are positioned close enough to a box corner to provide rigidity.

5. The box of claim 4 comprising two elongated ribs positioned between the containment walls.

6. The box of claim 1 in which the elongated rib has a beveled bottom surface to allow smooth wall displacement during assembly.

7. The box of claim 5 in which the elongated ribs are rigid and are integral with the cover frame.

* * * * *